US006922954B2

(12) United States Patent
Bradley et al.

(10) Patent No.: US 6,922,954 B2
(45) Date of Patent: Aug. 2, 2005

(54) GROUND RETENTION STAKE FOR OUTDOOR PEDESTAL

(75) Inventors: John J. Bradley, Colleyville, TX (US); Guy Castonguay, Ft. Worth, TX (US); Miguel Angel Herrera Bucio, Tamaulipas (MX); José Gustavo Fernández Tea, Tamaulipas (MX); Mariano Perez Vazquez, Tamaulipas (MX)

(73) Assignee: Corning Cable Systems LLC, Hickory, NC (US)

( * ) Notice: Subject to any disclaimer, the term of this patent is extended or adjusted under 35 U.S.C. 154(b) by 0 days.

(21) Appl. No.: 10/319,077

(22) Filed: Dec. 13, 2002

(65) Prior Publication Data

US 2004/0115009 A1 Jun. 17, 2004

(51) Int. Cl.[7] ..... E02D 5/80
(52) U.S. Cl. ..... 52/162; 52/155
(58) Field of Search ..... 52/155, 156, 162, 52/163, 164; 248/545; 405/259.1

(56) References Cited

U.S. PATENT DOCUMENTS 945,269 A * 1/1910 Fuchs ..... 52/164
954,510 A * 4/1910 Fuchs ..... 52/164
1,153,450 A * 9/1915 Schaff ..... 52/155
2,334,989 A * 11/1943 Brickman ..... 52/162
2,633,947 A * 4/1953 Schiff ..... 52/162
2,955,430 A * 10/1960 Alston ..... 52/156
3,404,212 A * 10/1968 Mack et al. ..... 174/38
3,769,768 A * 11/1973 Bertrand ..... 52/154
4,522,530 A * 6/1985 Arthur ..... 404/10
4,649,678 A * 3/1987 Lamson ..... 52/103
5,058,337 A * 10/1991 O'Connor ..... 52/162
6,263,601 B1 * 7/2001 Emert ..... 40/564
6,474,028 B2 * 11/2002 Cusimano et al. ..... 52/153

* cited by examiner

*Primary Examiner*—Sunil Singh
(74) *Attorney, Agent, or Firm*—Christopher C. Dreman

(57) ABSTRACT

A ground retention apparatus is provided for deterring the theft of services from an outdoor pedestal. The ground retention apparatus includes a ground stake having a first end attached to the pedestal and a second end opposite the first end for engaging the ground beneath the pedestal. The ground retention apparatus further includes a stop plate secured to the ground stake medially between the first end and the second end. The stop plate defines a hinge line separating a lower portion that is stationary and an upper portion that is movable relative to the lower portion between a first position wherein the upper portion is generally parallel to the lower portion and a second position wherein the upper portion is angled relative to the lower portion. The stop plate prevents the ground stake from being removed from the ground, thereby deterring unauthorized access to the equipment inside the pedestal.

6 Claims, 6 Drawing Sheets

GROUND RETENTION STAKE FOR OUTDOOR PEDESTAL

FIELD OF THE INVENTION

The present invention relates generally to outdoor pedestals for protecting utility and communications equipment from damage due to exposure to adverse environmental conditions, such as wind, moisture, dust or dirt, and infestation. More particularly, the invention relates to a ground retention stake for an outdoor pedestal that deters the theft of utility or communications services.

BACKGROUND OF THE INVENTION

Utility (e.g., power) and communications (e.g., telephone, Internet, cable television, etc.) service providers routinely utilize metal, plastic or composite enclosures to protect utility and communications equipment above ground from damage due to exposure to adverse environmental conditions, such as wind, moisture, dust or dirt and infestation. Such above-ground enclosures, referred to herein as "outdoor pedestals," may be vented to protect active equipment, such as signal splitters and boosters, or may be entirely sealed to protect only passive equipment, such as terminations or tap ports. A limited number of outdoor pedestals may also be pressure, humidity or temperature controlled to facilitate the operating requirements of certain equipment. Regardless, the majority of outdoor pedestals are placed directly on the ground over the equipment for ease of installation and reconfiguration of the network. In some instances, the outdoor pedestal includes a base that is buried a minimal depth below the surface of the ground and a removable cover that is locked onto the base with a padlock or a locking mechanism that requires an industry specific tool to open. In other instances, the outdoor pedestal includes a lockable door, or a cover having a lockable door that is secure to a base. In either case, the outdoor pedestal is often maintained in position over the equipment by a ground stake that is driven into the earth beneath the equipment.

Outdoor pedestals may be located at any suitable location that is convenient to the service network. As a result, a large number of outdoor pedestals are located very near to businesses, residential homes and apartment buildings. These locations make the outdoor pedestals particularly vulnerable to attempts to steal the utility and/or communications services. In some localities, the outdoor pedestal itself is stolen for the scrap value of the material, for example, aluminum. Cable television services are especially vulnerable to attempted theft because of the relative ease with which the CATV signal may be intercepted, commonly referred to as "tapped," and the relative difficulty of the CATV service provider to detect the theft without physically inspecting the tap ports located within the outdoor pedestal. Deterring or preventing theft of utility and/or communications services, especially cable television services, has become increasingly important as service networks extend further into dense urban environments and remote rural areas. In both instances, the opportunity for theft is high and the likelihood of detection is low. With the increasing use of coaxial cable to carry other broadband communications services, such as digital movies and Internet access, attempts to illegally obtain cable services will almost certainly continue to proliferate.

Most manufacturers of outdoor pedestals provide some form of security feature that prevents unauthorized access to the equipment housed within the pedestal. Known security features include the previously mentioned padlocks and locking mechanisms that require special keys or tools available only to authorized field service technicians. In some cases, the known security features have been successful theft deterrents. In an increasing number of instances, however, prospective thieves have circumvented the existing security features by simply removing the entire outdoor pedestal from over the equipment, making an illegal connection to the service, and replacing the outdoor pedestal in its original position over the equipment. Accordingly, what is needed is an outdoor pedestal for protecting utility and/or communications equipment that includes an effective and reliable means for preventing the pedestal from being removed to expose the equipment, thereby deterring theft of the outdoor pedestal itself, or of the utility and/or communications services.

BRIEF DESCRIPTION OF THE DRAWINGS

The present invention will be described in conjunction with the accompanying drawings in which like reference numerals represent the same or similar parts in the various views. The drawings, which are incorporated in and constitute a part of this specification, provide a further understanding of the invention, illustrate various embodiments of the invention, and, together with the description, help to fully explain the principles and objects thereof. More specifically.

DETAILED DESCRIPTION OF THE INVENTION

The invention is described more fully hereinafter with reference to the accompanying drawings, in which various embodiments of the invention are shown. The invention may, however, be embodied in many different forms, and therefore, should not be construed as being limited to the embodiments described and shown herein. Illustrative embodiments are set forth herein so that this description will be thorough and complete, and will fully convey the best mode and intended scope of the claimed invention, while enabling those skilled in the art to make and practice the invention without undue experimentation.

Figure 1:
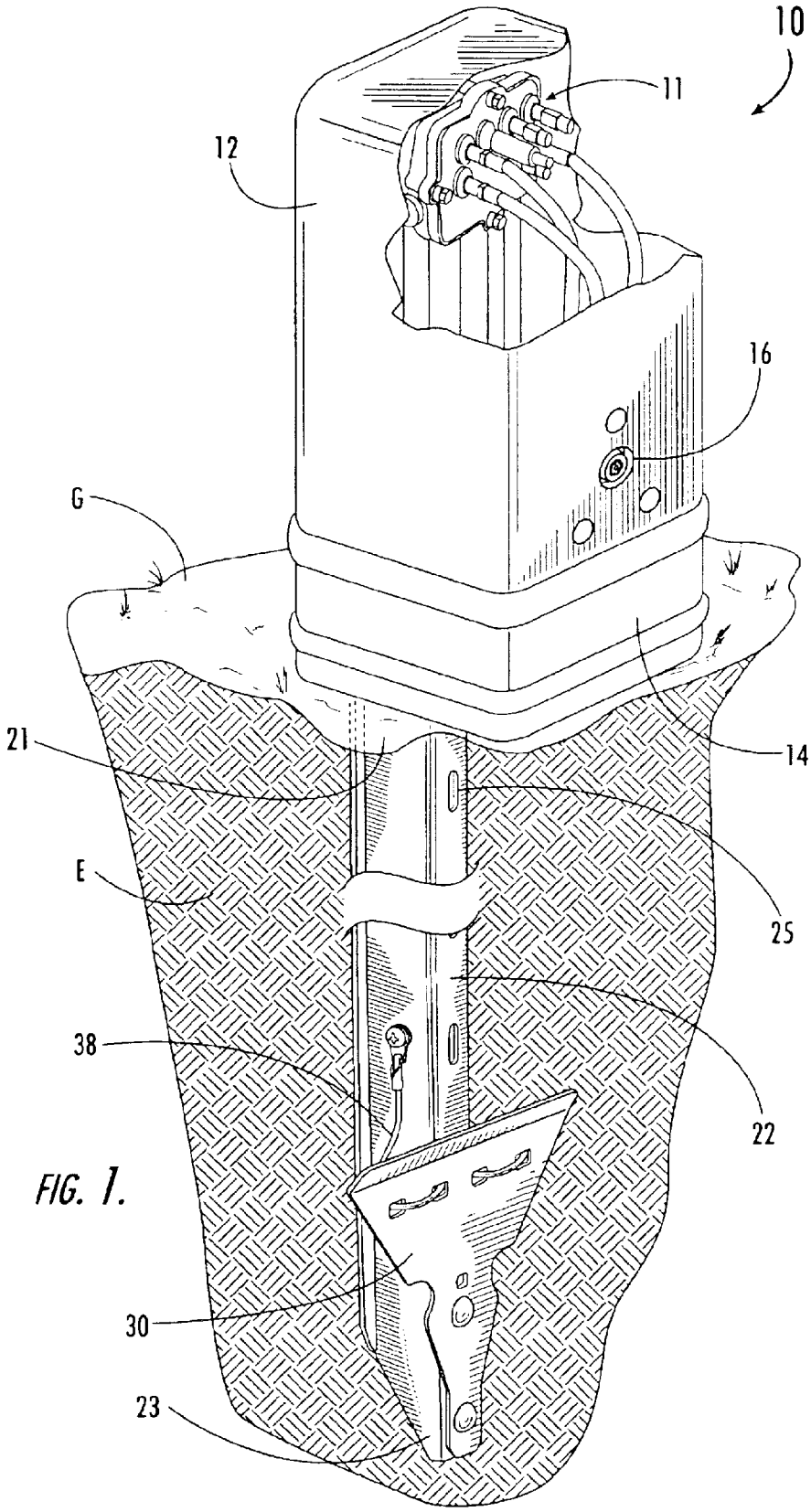
FIG. 1 is an environmental perspective view of an outdoor pedestal including a ground retention apparatus according to the invention shown installed above the ground over utility and/or communications equipment.
Figure 2:
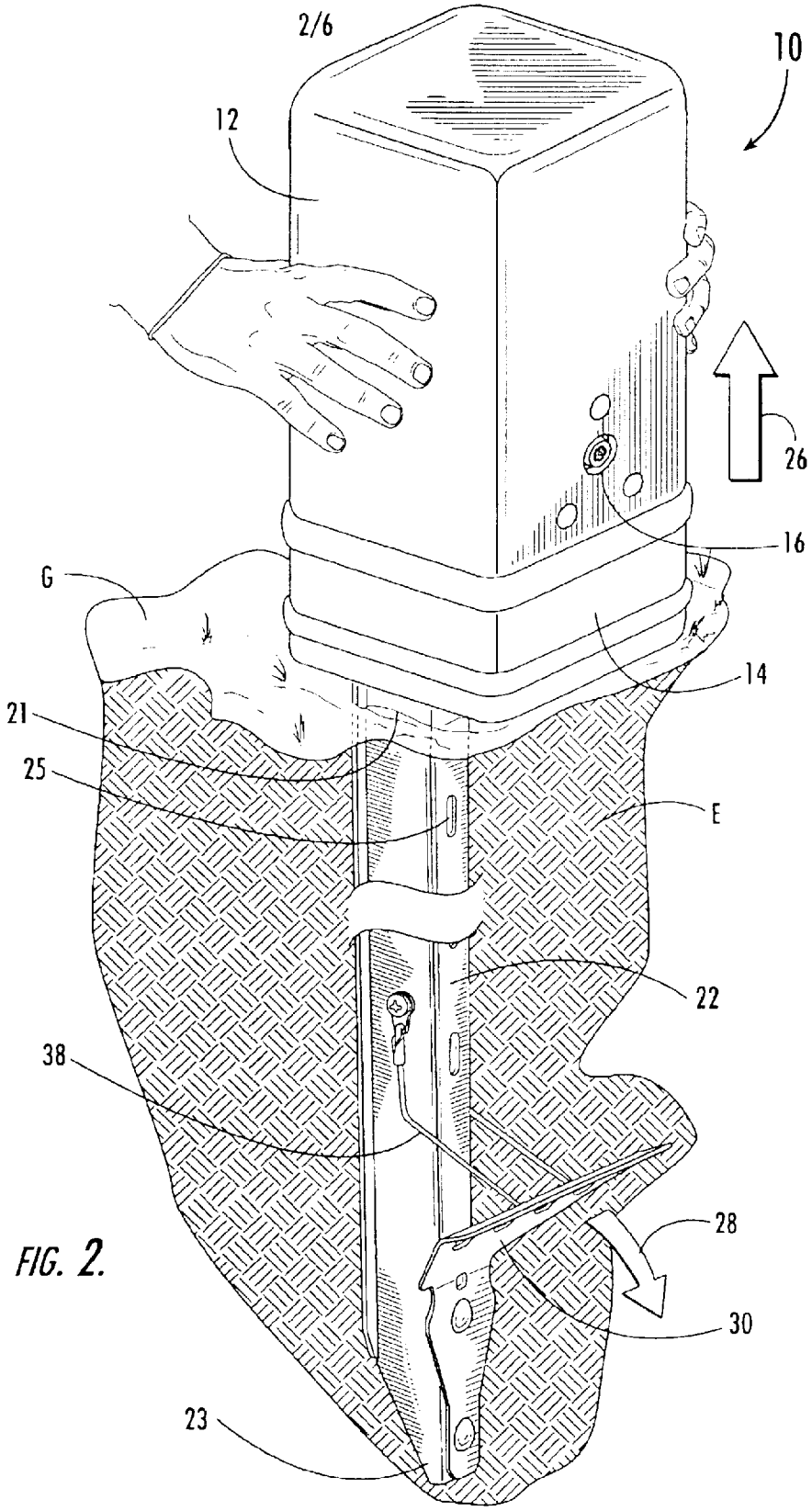
FIG. 2 is an environmental perspective view illustrating the operation of the ground retention apparatus to prevent the outdoor pedestal of FIG. 1 from being lifted above the ground, thereby deterring theft of the outdoor pedestal or utility and/or communications services.

Referring now to the accompanying drawings, an outdoor pedestal 10 of the type commonly used to protect utility and/or communications equipment 11 from adverse conditions, such as wind, moisture from rain or snow, dirt or dust, and infestation, is shown in FIGS. 1 and 2. As shown, the outdoor pedestal 10 comprises a base 12 and a cover 14 that is secured on the base 12. The base 12 and the cover 14 may, however, be integrally formed, or the outdoor pedestal 10 may comprise only the cover 12. Regardless, the outdoor pedestal 10 defines an interior cavity (not shown) for housing the utility and/or communications equipment 11. In some cases, the utility and/or communications equipment 11 may be active, such as signal splitters and boosters, and the outdoor pedestal 10 is vented. In other instances, the equipment 11 may be passive, such as network terminations or tap ports, and the outdoor pedestal 10 is entirely sealed. Typically, the outdoor pedestal 10 is installed directly on the ground G at a convenient location in the utility or communications network. For example, the outdoor pedestal 10 may be located near businesses, residential homes, or apartment buildings where terminations between a network service cable and customer drops are made. As such, the outdoor pedestal 10 inadvertently provides an opportunity for theft of services to occur by unauthorized persons attempting to make an illegal connection, commonly referred to as "tapping," into the network service cable. To deter the theft of services, the cover 12 is typically provided with a padlock or a locking mechanism 16 that requires a special tool available only to an authorized field technician. Thus, the cover 12 cannot be removed from the base 14 with ordinary hand tools to obtain access to the equipment and/or terminations or taps 11 within the outdoor pedestal 10 without causing obvious damage to the cover 12, the base 14, or the padlock or locking mechanism 16. However, theft of service from conventional outdoor pedestals 10 may occur and remain undetected for a period of time if the entire outdoor pedestal 10 is lifted off the ground G, and replaced over the equipment 11 once the illegal connection has been made.

Conventional outdoor pedestals 10 are made of durable metal, plastic or composite materials and are secured over the equipment 11 by a rigid stake that is driven into the earth E. The present invention provides a ground retention apparatus 20 (FIGS. 3–6) for an outdoor pedestal 10 that deters the theft of services by preventing the outdoor pedestal 10 from being lifted off the ground G sufficiently to access the utility and/or communications equipment 11 housed within the interior cavity defined by the outdoor pedestal 10. As previously mentioned, the ground retention apparatus comprises a ground stake 22 that is attached to the outdoor pedestal 10 and driven into the earth E beneath the utility and/or communications equipment 11. The ground stake 22 has a first end 21 for attachment to the outdoor pedestal 10 and a second end 23 opposite the first end 21. The ground stake 22 may be made of any high strength material, such as metal, plastic or reinforced composite, and if made of metal, may be provided with a corrosion resistant coating or paint. Preferably, however, the ground stake 22 is made of carbonized steel that is galvanized or powder coated. Furthermore, the ground stake 22 may be formed with a cross-sectional shape that increases its bending strength about the lateral axis. Accordingly, the ground stake 22 resists bending and/or breaking as it is driven into the ground. The first end 21 of the ground stake 22 is attached to the outdoor pedestal 10. The first end 21 of the ground stake 22 may be attached to an inner surface of the base 14 and/or cover 12, but preferably is attached to the outer surface of the outdoor pedestal 10 with suitable fasteners, such as bolts (not shown), that are secured from the inside. Accordingly, the outdoor pedestal 10 and the ground stake 22 cannot be separated from the outside to obtain unauthorized access to the equipment 11. The ground stake 22 may further have one or more lightening holes 25 to reduce weight without adversely affecting its compressive or bending strength. A stop plate 30, as will be described in greater detail hereinafter, is fixed to the ground stake 22 medially between the first end 21 and the second end 23. Finally, the second end 23 of the ground stake 22 may be angled or pointed in a conventional manner to facilitate driving the ground stake 22 into the earth E.

The utility and/or communications equipment 11 is positioned at a suitable location convenient to the service network and the necessary electrical connections and/or terminations or taps are made. The outdoor pedestal 10 is then placed over the equipment 11 on the ground G. In the embodiment shown and described herein, the base 14 is positioned over the equipment 11 and a minimal portion of the base 14 is buried slightly beneath the surface of the ground G. The ground stake 22 is then driven, for example with a sledge hammer, into the earth E next to the base 14. Once the ground stake 22 has been driven a suitable depth into the earth E to secure the outdoor pedestal 10, the first end 21 of the ground stake 22 is attached to the outdoor pedestal 10. As previously mentioned, the ground stake 22 is preferably attached to the outer surface of the base 14 in a manner that prevents the outdoor pedestal 10 and the ground stake 22 from being separated. Accordingly, the outdoor pedestal 10 cannot simply be stolen or removed to access the equipment and/or terminations or taps 11 housed therein. Once the ground stake 22 is secured to the base 14, the cover 12 is positioned on the base 14 and locked thereto. As shown in FIG. 1, the stop plate 30 remains generally parallel to the longitudinal axis defined by the ground stake 22 while the ground stake 22 is driven into the earth E and as long as the ground stake 22 remains undisturbed. The padlock or locking mechanism 16 permits only an authorized field technician having a key or industry special tool to remove the cover 12 from the base 14. Thus, an unauthorized person attempting to steal the outdoor pedestal 10 itself or attempting to make an illegal connection to the service will have to lift the outdoor pedestal 10 and the ground stake 22 entirely out of the earth E, or at least sufficiently to gain access to the equipment and/or terminations or taps 11 within the interior cavity defined by the outdoor pedestal 10.

The operation of the ground retention apparatus 20 to prevent the outdoor pedestal 10 from being lifted off the ground is illustrated in FIG. 2. If the outdoor pedestal 10, and hence the ground stake 22, are lifted in the direction indicated by the arrow 26, the stop plate 30 will move relative to the ground stake 22 in the direction indicated by the arrow 28. When the stop plate 30 moves from the first position shown in FIG. 1 wherein the stop plate 30 is generally parallel to the longitudinal axis defined by the ground stake 22 to the second position shown in FIG. 2 wherein the stop plate 30 is angled relative to the longitudinal axis defined by the ground stake 22, earth E will fill in space between the stop plate 30 and the ground stake 22. As a result, it will become increasingly difficult, if not impossible, to continue lifting the outdoor pedestal 10 and the ground stake 22. The movement of the stop plate 30 must be constrained to prevent the unauthorized person from exerting an upward force that is sufficient to overcome the resistance of the stop plate 30 against the earth E. Accordingly, a restraining cable 38 is provided to limit the movement of the stop plate 30 in a manner to be described hereinafter in greater detail. If necessary, an authorized field technician can remove the outdoor pedestal 10 by digging around the ground stake 22 and thereby loosen the earth E sufficiently to permit the outdoor pedestal 10 and the ground stake 22 to be lifted off the ground G.

Figure 3A:
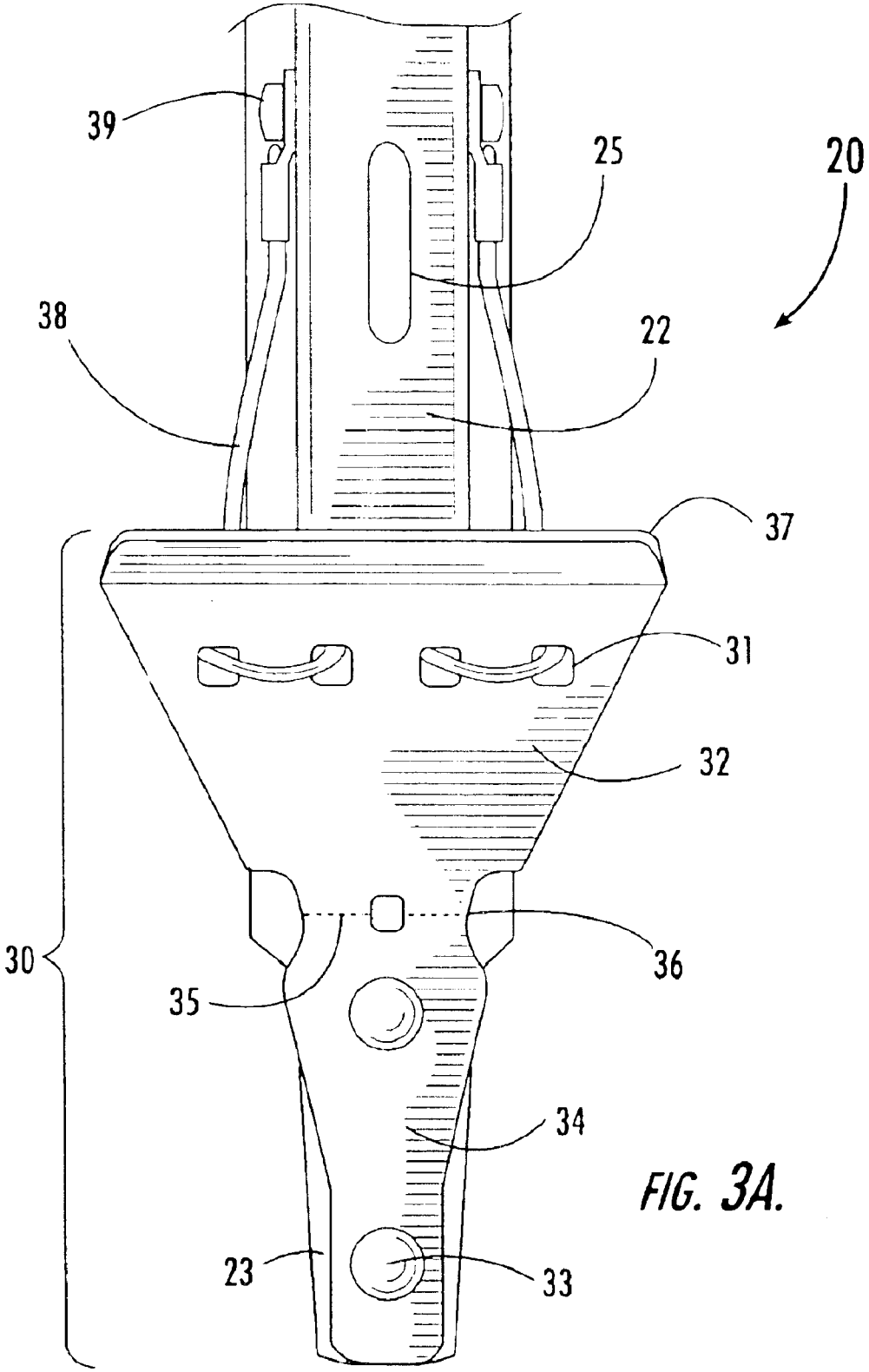
FIG. 3A is an enlarged front view of a first preferred embodiment of a ground retention apparatus according to the invention.
Figure 3B:
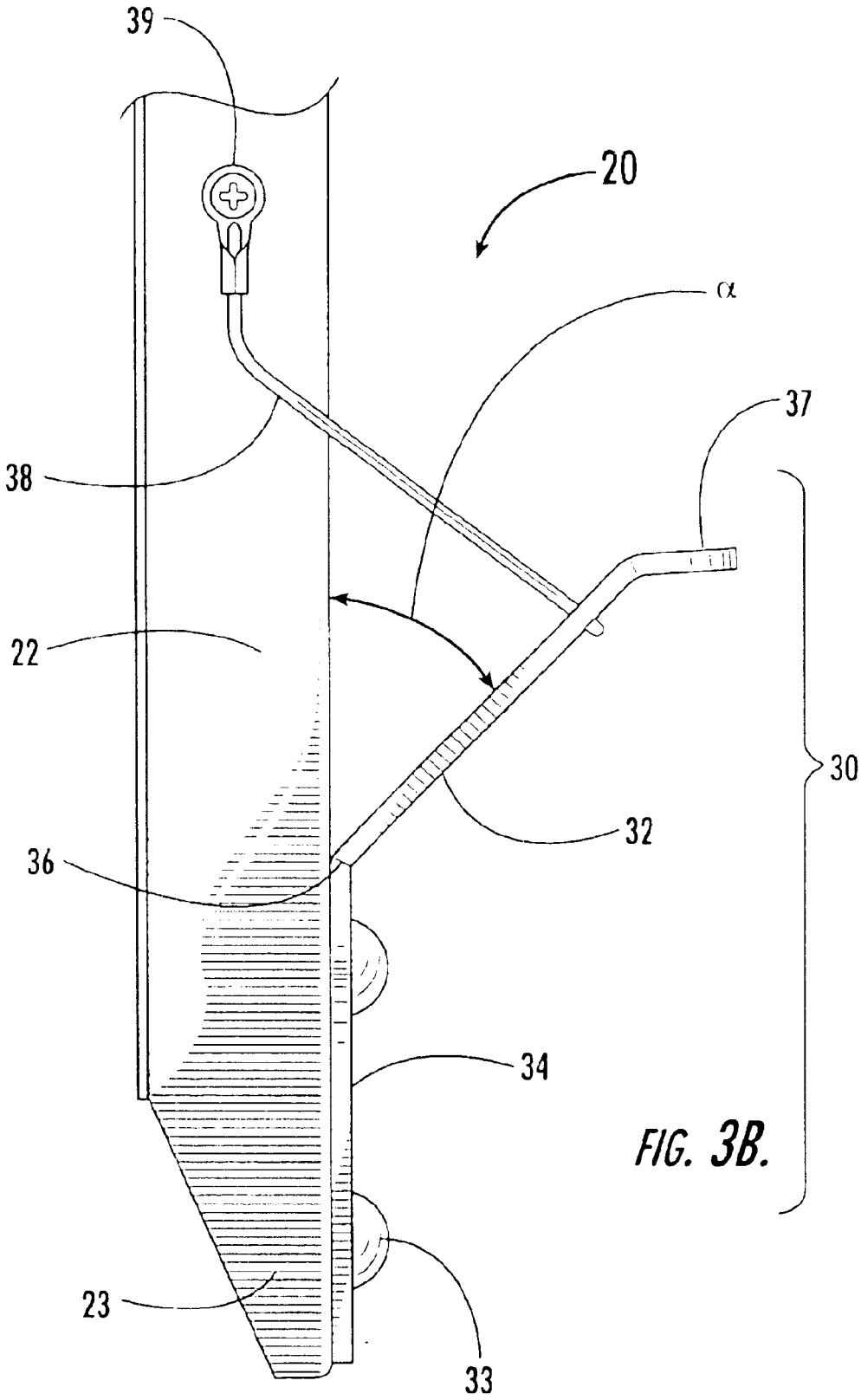
FIG. 3B is an enlarged side view of the first preferred embodiment of the ground retention apparatus.

A first preferred embodiment of a ground retention apparatus 20 according to the invention is shown in FIGS. 3A and 3B. As shown, the ground retention apparatus 20 comprises the stop plate 30 fixed to the ground stake 22 medially between the first end 21 and the second end 23. The stop plate 30 may be fixed at any location on the ground stake 22 that will be surrounded by earth when the ground stake 22 is driven into the earth E. Preferably, however, the stop plate 30 is located nearer the second end 23 of the ground stake 22. Most preferably, the stop plate 30 is fixed to the ground stake 22 immediately adjacent the second end 23 to maximize the distance between the base 14 of the outdoor pedestal 10 and the stop plate 30, and thus, increase the resistance of the stop plate 30 against the earth E. The stop plate 30 comprises an upper portion 32 that is separated from a lower portion 34 by a hinge line 35. The lower portion 34 is fixed to the ground stake 22 in any suitable manner, for example by welds, glue or mechanical fasteners, such that the lower portion 34 does not move relative to the ground stake 22 and remains parallel to the longitudinal axis defined by the ground stake 22. As shown, the lower portion 34 of the stop plate 30 is fixed to the ground stake 22 by at least one, and preferably, at least a pair of bolts 33 that are secured from the inside of ground stake 22. The bolts 33 protrude minimally so as to not interfere significantly when the ground stake 22 is driven into the earth E. The upper portion 32 is not fixed to the ground stake 22, and thus, is free to move relative to the lower portion 34. In particular, the upper portion 32 is free to rotate about the hinge line 35 relative to the lower portion 34.

In the first preferred embodiment of the ground retention apparatus 20 shown in FIGS. 3A and 3B, the hinge line 35 (indicated by the broken line in FIG. 3A) is defined by a pair of relief cuts 36 formed along the outer edges of the stop plate between the upper portion 32 and the lower portion 34. The relief cuts 36 create localized yield points in the material of the stop plate 30 that permit the upper portion 32 to move relative to the lower portion 34 about the hinge line 35. In particular, the upper portion 32 rotates about the hinge line 35 in a direction away from the ground stake 22 (indicated by the arrow FIG. 2). The ground retention apparatus 20 further comprises at least one retaining cable 38 for limiting the movement (i.e., rotation) of the upper portion 32 relative to the lower portion 34. The retaining cable 38 may be made of any high tensile strength material, such as braided or twisted metal, and is preferably coated, painted or galvanized to resist corrosion underground. The retaining cable 38 is secured to the ground stake 22 between the stop plate 30 and the first end 21 in any suitable manner. As shown herein, the retaining cable 38 is secured by at least one, and preferably two, fasteners, such as cable eye hooks and screws 39. The retaining cable 38 may likewise be secured to the upper portion 32 of the stop plate 30 in any suitable manner. As shown herein, the upper portion 32 of the stop plate 30 has at least one, and preferably two, holes 31 and the retaining cable 38 is threaded from the ground stake 22 through the hole(s) 31 and back to the ground stake 22. The length of the retaining cable 38 is selected so that the rotation of the upper portion 32 about the hinge line 35 is limited to a predetermined angle of rotation $\alpha$. The angle of rotation $\alpha$ is less than about ninety degrees (90°), and preferably is between about thirty degrees (30°) and about sixty degrees (60°). The upper portion 32 of the stop plate 30 may also be provided with an angled lip 37. The lip 37 protrudes outwardly from the upper portion 32 to hold the upper portion 32 against the ground stake 22 while the ground stake 22 is driven into the earth E, and to initiate movement of the upper portion 32 from the first position to the second position when the outdoor pedestal 10 and the ground stake 22 are lifted.

Figure 4:
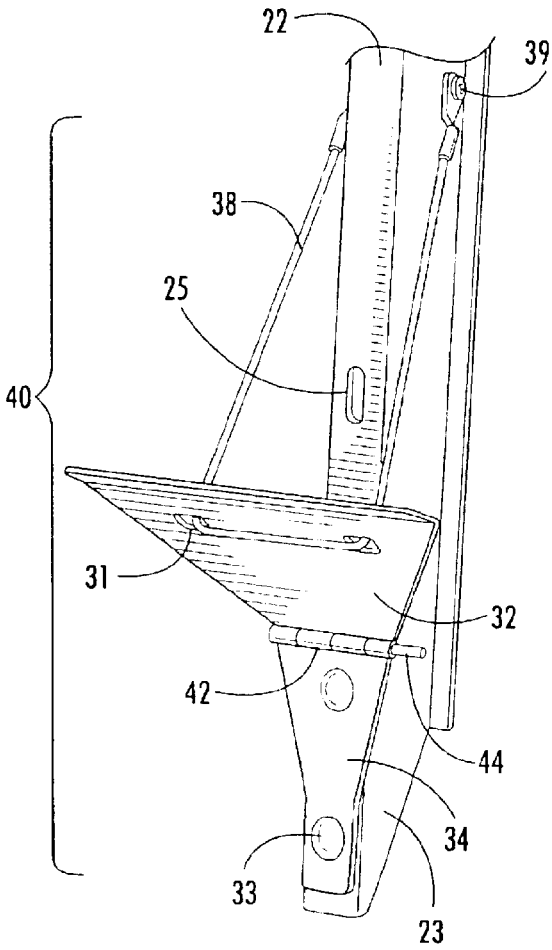
FIG. 4 is a right-hand perspective view of a second preferred embodiment of a ground retention apparatus according to the invention.

A second preferred embodiment of the ground retention apparatus 20 shown in FIG. 4 comprises an alternative stop plate 40. In all other pertinent respects, the ground retention apparatus 20 is the same as previously described. In particular, the operation of the outdoor pedestal 10 and the ground stake 22 are as described herein with respect to FIGS. 1 and 2. Thus, like reference numerals are utilized in FIG. 4 to represent the same, or similar, parts. The stop plate 40 is similar to the stop plate 30 except that the hinge line 35 is defined by a mechanical hinge, and in particular, a conventional piano hinge 42. As is well known, a first portion of the piano hinge 42 is formed on the upper portion 32 of the stop plate 40 and a second portion of the piano hinge 42 is formed on the lower portion 34 of the stop plate 40. The upper portion 32 is then attached to the lower portion 34 by a hinge pin 44. As such, the upper portion 32 is free to rotate relative to the lower portion 34 about the hinge pin 44. In particular, the upper portion 32 rotates about the lower portion 34 the predetermined angle $\alpha$ between the first position wherein the upper portion is generally parallel to the lower portion 34 and the second position wherein the upper portion is, angled relative to the lower portion 34. At least one retaining cable 38 may be secured between the stop plate 40 and the ground stake 22 to limit the rotation of the upper portion 32 relative to the lower portion 34 in the manner previously described.

Figure 5:
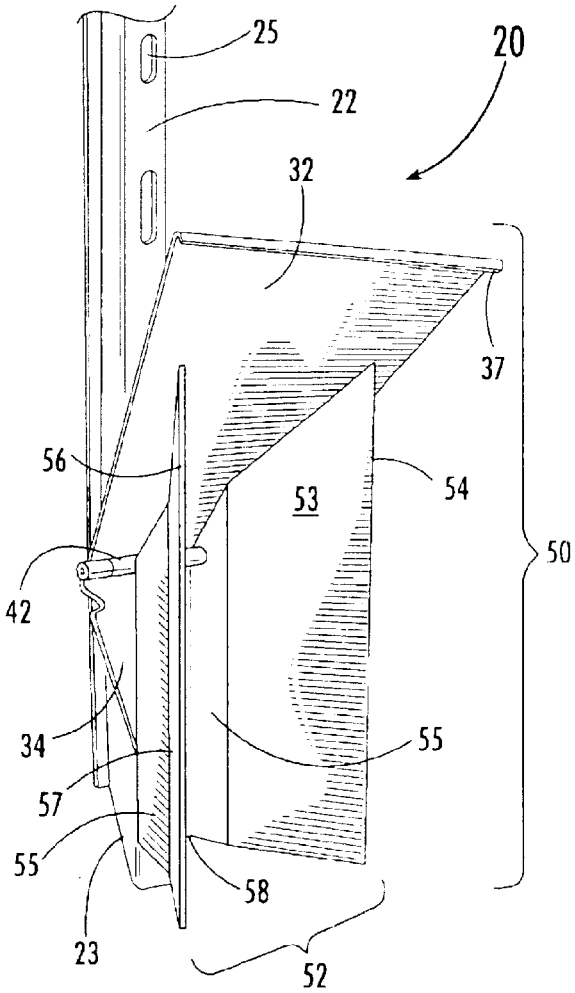
FIG. 5 is a left-hand perspective view of a third preferred embodiment of a ground retention apparatus according to the invention.

A third preferred embodiment of the ground retention apparatus 20 shown in FIG. 5 comprises an alternative stop plate 50. In all other pertinent respects, the ground retention apparatus 20 is the same as previously described. In particular, the operation of the outdoor pedestal 10 and the ground stake 22 are as described herein with respect to FIGS. 1 and 2. Thus, like reference numerals are utilized in FIG. 5 to represent the same, or similar, parts. The stop plate 50 is similar to the stop plate 40 except that the retaining cable 38 is replaced by a support plate 52. Furthermore, the piano hinge 42 may be replaced by the relief cuts 36 shown in FIG. 3, or by any other means that permits the upper portion 32 to rotate about the lower portion 34 between the first position and the second position. The support plate 52 is made of any suitable material having high strength and rigidity (e.g., aluminum), and preferably, is made of the same material as the remainder of the stop plate 50. The support plate 52 may have any form that functions to limit the rotation of the upper portion 32 relative to the lower portion 34 about the piano hinge 42. As shown, the support plate 52 comprises a first flange 54 that depends outwardly from the lower portion 34 of the stop plate 50 and a second flange 56 that depends outwardly from the lower portion 34. The second flange 56 is spaced apart from the first flange 54 by a connecting flange 58 that is generally parallel to the lower portion 34 of the stop plate 50. The connecting flange 58 of the support plate 52 is fixed to the lower portion 34 of the stop plate 50 by suitable means, for example by welds, glue or mechanical fasteners. Alternatively, the connecting flange 58 may be fixed to the ground stake 22 adjacent the second end 23. Preferably, the first flange 54 is a compound flange comprising a straight portion 55 that is generally perpendicular to the connecting flange 58 and an angled portion 53 that is angled outwardly relative to the straight portion. Likewise, the second flange 56 is a compound flange comprising a straight portion 55 and an angled portion 57 that is angled outwardly relative to the straight portion. Thus, the support plate 52 serves to break apart and separate the earth as the ground stake 22 is driven into the ground and as a potential thief pulls the ground stake 22 from the ground. The loosened earth more easily permits the upper portion 32 of the stop plate 50 to rotate to the second position and the earth to fill in between the stop plate 50 and the ground stake 22.

Figure 6:
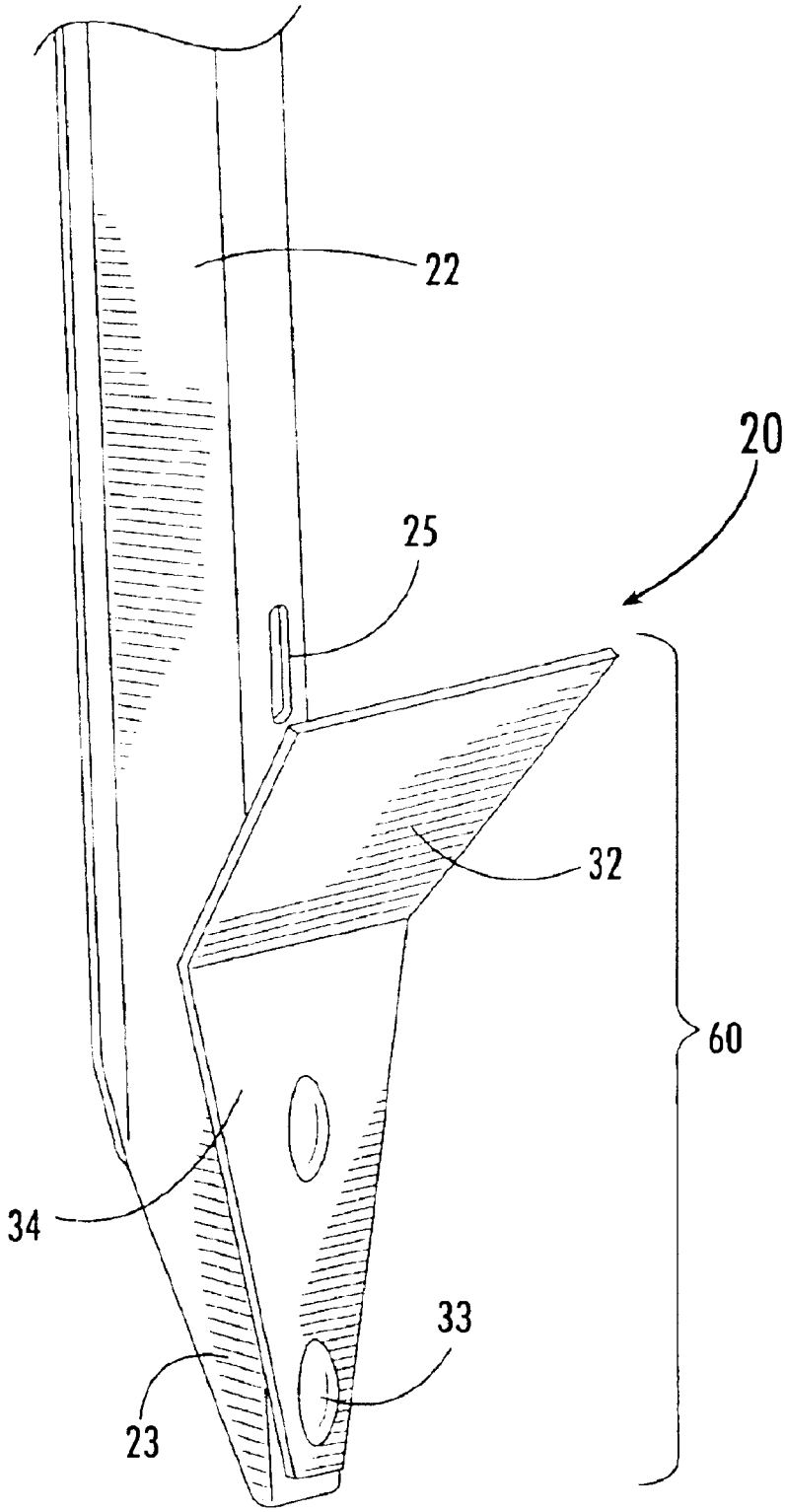
FIG. 6 is a left-hand perspective view of a fourth preferred embodiment of a ground retention apparatus according to the invention.

A fourth preferred embodiment of the ground retention apparatus 20 shown in FIG. 6 comprises an alternative stop plate 60. In all other pertinent respects, the ground retention apparatus 20 is the same as previously described. In particular, the operation of the outdoor pedestal 10 and the ground stake 22 are as described herein with respect to FIGS. 1 and 2. Thus, like reference numerals are utilized in FIG. 6 to represent the same, or similar, parts. The stop plate 60 is different from the embodiments previously described in that the upper portion 32 of the stop plate 60 is fixed relative to the lower portion 34. In particular, the upper portion 32 is fixed at the predetermined angle $\alpha$ relative to the lower portion 34. Thus, the upper portion 32 of the stop plate 60 is permanently oriented in the angled, or second, position.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that further modifications and other embodiments are intended to be included within the scope of the appended claims. Although specific terms are employed herein, they are used in a generic and descriptive sense only and not for purposes of limitation.

That which is claimed is:

1. An outdoor pedestal assembly comprising:

a pedestal comprising an above-ground enclosure defining an internal cavity;

at least one interconnection between a communications service provider and a communications subscriber; and a locking mechanism for preventing unauthorized access to the internal cavity;

a ground stake having a first end for attachment to the pedestal and a second end opposite the first end; and a stop plate secured to the ground stake medially between the first end and the second end, the stop plate comprising a hinge line separating a lower portion that is stationary and an upper portion that is movable relative to the lower portion, the hinge line defined by a pair of laterally spaced apart relief cuts fanned in the stop plate that permit the upper portion to yield and rotate about the hinge line when the ground stake is removed from the ground, the upper portion of the stop, plate having a pair of holes for receiving a retaining cable with opposed ends that are secured to the ground stake adjacent to the second end.

2. An outdoor pedestal assembly according to claim 1 wherein the retaining cable limits the movement of the upper portion relative to the lower portion.

3. An outdoor pedestal assembly comprising:

a pedestal comprising an above-ground enclosure defining an internal cavity;

at least one interconnection between a communications service provider and a communications subscriber disposed within the internal cavity; and a locking mechanism for preventing unauthorized access to the internal cavity;

a ground stake having a first end for attachment to the pedestal and a second end opposite the first end; and a stop plate secured to the ground stake medially between the first end and the second end, the stop plate comprising a hinge line separating a lower portion that is stationary and an upper portion that is movable relative to the lower portion, the hinge line defined by a piano hinge that permits the upper portion of the stop plate to rotate relative to the lower portion when the ground stake is removed from the ground, the upper portion of the stop plate having a pair of holes for receiving a retaining cable with opposed ends that are secured to the ground stake adjacent to the second end.

4. An outdoor pedestal for protecting equipment front adverse environmental conditions and unauthorized access, the outdoor pedestal comprising an enclosure defining an internal cavity housing equipment for providing communications services to a subscriber and comprising a locking mechanism for preventing unauthorized access to the equipment;

a ground stake having a first end secured to the enclosure and a second end opposite the first end and depending from the enclosure, the ground stake engaging the ground to a sufficient depth such that the enclosure is positioned over the equipment; and a stop plate secured to the ground stake medially between the first end and the second end, the stop plate comprising a hinge line separating a lower portion that is stationary and an upper portion that is movable relative to the lower portion between a first position wherein the upper portion is generally parallel to the lower portion and a second position wherein the upper portion is angled relative to the lower portion, the hinge line defined by a pair of laterally spaced apart relief cuts formed in the stop plate that permit the upper portion to yield and rotate about the hinge line when the aground stake is removed from the ground, the upper portion of the stop plate having a pair of holes for receiving retaining cable with opposed ends that are secured to the ground stake adjacent to the second end.

5. An outdoor pedestal according to claim 4 wherein the retaining cable limits the movement of the upper portion relative to the lower portion.

6. An outdoor pedestal for protecting equipment from adverse environmental conditions and unauthorized access, the outdoor pedestal comprising an enclosure defining an internal cavity housing equipment for providing communications services to a subscriber and comprising a locking mechanism for preventing unauthorized access to the equipment;

a ground stake having a first end secured to the enclosure and a second end opposite the first end and depending from the enclosure, the ground stake engaging the ground to a sufficient depth such that the enclosure is positioned over the equipment; and a stop plate secured to the ground stake medially between the first end and the second end, the stop plate comprising a hinge line separating a lower portion that is stationary and an upper portion that is movable relative to the lower portion between a first position wherein the upper portion is generally parallel to the lower portion and a second position wherein the upper portion is angled relative to the lower portion, the hinge line defined by a piano hinge that permits the upper portion of the stop plate to rotate relative to the lower portion when the ground stake is removed from the ground, the upper portion of the stop plate having a pair of holes for receiving a retaining cable with opposed ends that are secured to the ground stake adjacent to the second end.

* * * * *

UNITED STATES PATENT AND TRADEMARK OFFICE

CERTIFICATE OF CORRECTION

PATENT NO. : 6,922,954 B2
DATED : August 2, 2005
INVENTOR(S) : John J. Bradley et al.

It is certified that error appears in the above-identified patent and that said Letters Patent is hereby corrected as shown below:

Column 8,
Line 58, delete “front” and substitute -- from --.

Column 9,
Line 14, delete “aground” and substitute -- ground --.

Signed and Sealed this

Fourth Day of October , 2005

JON W. DUDAS
*Director of the United States Patent and Trademark Office*